US005343968A

United States Patent [19]

Glowka

[11] Patent Number: 5,343,968

[45] Date of Patent: Sep. 6, 1994

[54] DOWNHOLE MATERIAL INJECTOR FOR LOST CIRCULATION CONTROL

[75] Inventor: David A. Glowka, Tijeras, N. Mex.

[73] Assignee: The United States of America as represented by the United States Department of Energy, Washington, D.C.

[21] Appl. No.: 686,442

[22] Filed: Apr. 17, 1991

[51] Int. Cl.[5] ..... E21B 33/138; E21B 33/14

[52] U.S. Cl. ..... 175/231; 166/334; 175/215; 175/257; 175/317; 175/324; 405/269

[58] Field of Search ..... 175/231, 215, 214, 218, 175/257, 315, 317, 324, 72; 166/332, 334, 242, 222, 223; 405/269

[56] References Cited

U.S. PATENT DOCUMENTS

| | | | |
|---|---|---|---|
| 3,175,628 | 3/1965 | Dellinger | 175/72 |
| 3,415,318 | 12/1968 | Meijs | 175/72 X |
| 3,448,800 | 6/1969 | Parker et al. | 175/72 X |
| 3,799,278 | 3/1974 | Oliver | 175/237 |
| 4,072,166 | 2/1978 | Tiraspolsky et al. | 137/496 |
| 4,378,050 | 3/1983 | Tatevosian et al. | 166/309 |
| 4,449,856 | 5/1984 | Tokoro et al. | 405/269 |
| 4,645,006 | 2/1987 | Tinsley | 166/374 |
| 4,823,890 | 4/1989 | Lang | 175/318 |
| 4,842,066 | 6/1989 | Galiakbarov et al. | 166/265 |
| 5,006,017 | 4/1991 | Yoshida et al. | 405/269 X |

FOREIGN PATENT DOCUMENTS

| | | | |
|---|---|---|---|
| 9966 | 1/1980 | Japan | 405/269 |
| 65622 | 5/1980 | Japan | 405/269 |
| 28922 | 3/1981 | Japan | 405/269 |
| 62212 | 4/1983 | Japan | 405/269 |
| 55115 | 3/1985 | Japan | 405/269 |
| 2085509 | 4/1982 | United Kingdom | 405/269 |

*Primary Examiner*—Hoang C. Dang

*Attorney, Agent, or Firm*—Luis M. Ortiz; James H. Chafin; William R. Moser

[57] ABSTRACT

Apparatus and method for simultaneously and separately emplacing two streams of different materials through a drillstring in a borehole to a downhole location for lost circulation control. The two streams are mixed outside the drillstring at the desired downhole location and harden only after mixing for control of a lost circulation zone.

4 Claims, 5 Drawing Sheets

(AA)

DOWNHOLE MATERIAL INJECTOR FOR LOST CIRCULATION CONTROL

The United States Government has rights in this invention pursuant to Contract No. DE-AC04-76DP00789 between the United States Department of Energy and American Telephone and Telegraph Company.

BACKGROUND OF THE INVENTION

The present invention relates generally to a device and method for injecting bridging materials and cementitious mud downhole for the purpose of controlling severe lost circulation and, more particularly, to a device and method for emplacing a quick-setting cement downhole while ensuring that premature setting does not occur inside the drill pipe. This invention is useful for any downhole or drilling operation where the problem of lost circulation is likely is occur, e.g. oil and gas drilling, geothermal drilling, coring operations, and mineral exploration.

Lost circulation is the phenomenon where circulating drilling fluid is lost to fractures or pores in the rock formation rather than returning to the surface through the wellbore annulus, as it does during normal drilling. In a wellbore, drilling fluid, such as cementitious mud, is pumped downhole and circulates to the surface to cool the bit, to carry rock chips out of the borehole, and in some cases to control the well; when lost circulation occurs, this fluid is lost to the rock formation due to an incompetent or permeable rock formation (characterized by a porous matrix, fractures, vugs, or caverns) which does not have adequate physical integrity or pore-fluid to support the hydrostatic pressure inside the wellbore.

Although drilling can continue under lost circulation conditions, it is generally imperative that the fluid loss be stopped as soon as possible after it is discovered for various reasons: the loss of the drilling fluid itself to the formation is expensive; changes in the rock formation being drilled cannot be easily detected if rock chips are not circulated out of the wellbore; rock chips lost to the formation can flow back into the wellbore when drilling stops, thus sticking to the drillstring in the hole; control of the well may be difficult or impossible if a high-pressure zone is encountered with the wellbore only partially filled with drilling fluid; drilling fluid invasion of the surrounding rock formation alters in-situ conditions and therefore affects the logging response of the formation; freshwater aquifers associated with loss zones can be contaminated by drilling mud and connate fluids (fluids trapped in the sediment and/or rock) produced at different wellbore intervals; and loss zones not treated during the drilling phase can cause casing cement to be lost to the open formation during completion operations, resulting in a poor or incomplete bond between the casing and the rock formation and requiring expensive remedial action to prevent inter-interval flow and (in geothermal wells) possible casing collapse when the well is put on production.

Lost circulation is a major problem in oil and gas well drilling and other types of exploration with the advent of exploration in deeper, more highly fractured producing formations; however, lost circulation problems tend to be more severe in geothermal drilling than in other types of drilling because of the highly fractured and underpressured nature of many geothermal formations.

Bridging materials (i.e. the particles added to drilling mud to form a bridge or a plug across a fracture) used as drilling mud additives for lost circulation control in oil and gas drilling are ineffective in plugging large fracture apertures, particularly under high-temperature conditions. Therefore, the standard lost circulation treatment in geothermal drilling is to fill the loss zone surrounding the wellbore with cement, which is both expensive and time-consuming due to the necessity of waiting for the cement to harden and then drilling through the cemented zone to reach new rock formation.

In geothermal drilling, lost circulation is typically the most costly problem routinely encountered. In mature geothermal areas, lost circulation costs represent an average of 10% of the total well costs, and in exploratory wells and developing fields, lost circulation costs often account for over 20% of total well costs.

Various methods and apparatus are known for delivering materials into the wellbore and/or for providing fluid access to the wellbore annulus, but most do not address the problem of lost circulation control.

U.S. Pat. No. 3,799,278 to D. L. Oliver described a downhole tool for providing fluid access to the wellbore annulus through the side of the drill pipe using a dropped dart or wireline in order to restore drilling mud circulation if the drill bit nozzle becomes clogged during operation. U.S. Pat. No. 4,072,166 to Tiraspolsky et al. describes a downhole tool for providing fluid access from the wellbore annulus to the drill pipe interior through the side of the pipe using the pressure drop of the flowing fluid to operate a valve, the purpose of the invention being to ensure the axial flow of fluid injected into the drill pipe during drilling while allowing interruption of the axial continuity and connecting the interior of the pipe directly with the exterior annulus space when the injection is broken off or when the flow descends below a minimum value.

U.S. Pat. No. 4,645,006 to Tinsley describes a downhole device for providing access to the wellbore annulus through the side of the drill pipe using the drill pipe internal pressure acting on a dropped actuator to open a sliding access valve, in order to restore the circulation of drilling mud if the drill bit nozzle becomes clogged during operation. U.S. Pat. No. 4,823,890 to Lang describes a reverse circulation drill bit and associated apparatus in a permanent concentric tubing arrangement for directing the flow of drilling fluids through the bit in a reverse circulation mode.

Thus, both the direct costs, and the unknown costs associated with possible contamination of freshwater aquifers, as well as other problems related to lost circulation control indicate an existing need for a system providing major-fracture fluid loss control. More particularly, there is an existing need for technology to plug major-fracture loss zones.

In addition to cost considerations, when the maximum thickness of the loss-zone fractures is greater than the diameter of the drill bit nozzles, it is not possible to plug the loss-zone with drilling mud additives without also plugging the bit nozzles. In such cases, it is necessary to use a material that either solidifies after it flows through the bit or is emplaced downhole after first removing the bit. In geothermal drilling, various cement formulations are pumped downhole for plugging major-fracture loss zones. While these cement treatments are generally effective in stopping fluid loss, they are expensive in both the quantity (hundreds of cubic feet) of cement required and the long waiting time (8–12 hours) for the cement to set before drilling can resume.

A new class of cementitious material is known as cementitious mud, which consists of bentonite drilling mud with added constituents for turning it into solid form, usually including an accelerator material for controlling the setting time. The formulations are developed to provide rapid-setting, temperature-driven, cements in which significant compressive strengths may be developed within short times. As an example, a cement formulated by mixing conventional bentonite mud with ammonium polyphosphate, borax, and magnesium oxide has been developed which attains significant compressive strength in less than two hours when sufficient concentrations of the magnesium oxide accelerator are used; the setting time decreases with temperature, and the material expands approximately 15% upon setting.

Even with the potential benefits derived from the use of these muds for plugging purposes, there is a problem with lack of control over the setting process to ensure that the fluid will not set up inside the drill pipe during field application. Thus, there is an existing need for an alternative emplacement technique for more effectively and economically plugging loss zones dominated by large fractures, vugs, and caverns. There is also an existing need for an alternative emplacement system that provides more control over the setting process in the hole so that the cementitious mud will not set up inside the drill pipe during field operation.

In an effort to find alternative materials for more effectively plugging major-fracture loss zones, cementitious muds with an encapsulated accelerator have been developed. Specifically, the accelerator, typically the magnesium oxide additive, is encapsulated with an inert material that is sheared off by fluid action at the bit nozzles. The inert material used for the encapsulant for the accelerator may be one of many materials. In this technique, the cementitious mud is mixed at the surface and pumped downhole, but since the accelerator is shielded from the other cement constituents by the inert encapsulant, the cement does not harden in the drill pipe regardless of the time required for pumping. As the cement flows through the nozzles, the encapsulant is sheared off, exposing the accelerator and initiating the cement setting process. The chemical setting reaction is then further accelerated as the cementitious mud flows into the high temperature formation. However, questions exist as to the timing and reliability of the encapsulation technique.

There is an existing need for an alternative system for emplacing cementitious mud downhole in case the encapsulation technique is unworkable, either consistently or at some proven parameters.

Known apparatus and methods for delivering plugging materials to the wellbore that do address the problem of lost circulation are subject to the necessity of avoiding premature set-up of the plugging material and the problems associated therewith. U.S. Pat. No. 4,378,050 to Tatevosian et al. describes a downhole tool for delivering a pre-mixed plugging material in a container to the bottom of a drill pipe and injecting it into the wellbore through the bit using a displacing agent (mechanical, fluid, or gas) to force the plugging material into the bit, with the goal of plugging a lost circulation zone. U.S. Pat. No. 4,842,066 to Galiakbarov et al. describes a downhole device for injecting a single stream of pre-mixed cement slurry downhole through the drill pipe to the location of a lost circulation zone in order to accomplish downhole separation of the components of a single fluid stream of cement slurry into a solid and liquid phase, with the purpose of plugging the lost circulation zone.

There is an existing need for a method and corresponding system for quickly and economically plugging lost circulation zones without requiring pulling or tripping the bit.

There is also an existing need for a method and corresponding system to allow the components of a two-component plugging material, such as cementitious mud, to be placed downhole simultaneously but separately, without mixing the components prior to emplacement in the wellbore, for lost circulation control.

SUMMARY OF THE INVENTION

In view of the above-described needs, it is an object of this invention to provide an alternative emplacement device and method for more effectively and economically plugging loss zones dominated by large fractures, vugs, and caverns.

It is another object of this invention to provide an alternative emplacement device and method for providing more control over the setting process in the hole so that the cement will not set up inside the drill pipe during field operation.

It is a further object of this invention to provide an alternative emplacement device and method for emplacing cementitious and downhole in case the encapsulation technique is unworkable, either consistently or at some proven parameters.

It is still another object of this invention to provide a method and corresponding system for quickly and economically plugging lost circulation zones without requiring pulling or tripping the bit.

It is an additional object of this invention to provide a method and corresponding system to allow the components of a two-component plugging material, such as cementitious mud, to be placed downhole simultaneously but separately, without mixing the components prior to emplacement in the wellbore, for lost circulation control.

Additional objects, advantages, and novel features of the invention will become apparent to those skilled in the art upon examination of the following description or may be learned by the practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, there is provided a downhole injector system for providing the components of a two-component plugging material, such as cementitious mud, to be placed downhole simultaneously but separately, without mixing the components prior to emplacement in the wellbore, for lost circulation control. More specifically, in a first embodiment according to the invention, the downhole injector system includes a separate tubing assembly which acts in conjunction with the drill pipe to deliver an accelerator slurry, or more specifically a magnesium oxide slurry, and a cementitious mud slurry downhole into the wellbore. In a second embodiment, the downhole injector system also includes an insert injector assembly installed in the drill pipe with which a portion of the tubing assembly mates to deliver the separate components of the slurry to different locations downhole prior to their mixing. The insert injector assembly includes a valve that opens to direct the accelerator slurry out of the side of the drill pipe and into the wellbore annulus above the bit. At the same time, a slurry of cementitious mud, or more specifically a slurry of bentonite mud, ammonium polyphosphate, and borax is pumped through the drill string and bit nozzles in the normal manner. The bit is situated above the loss zone, so that the two slurry streams exit the injector in separate locations, then enter the loss zone and mix, thereby initiating the chemical reaction that hardens the mud into cement.

BRIEF DESCRIPTION OF THE DRAWINGS

The accompanying drawings, which are incorporated in and form part of the specification, illustrate an embodiment to the present invention and, together with the description, serve to explain the principles of the invention.

DETAILED DESCRIPTION OF THE INVENTION

Figure 1:
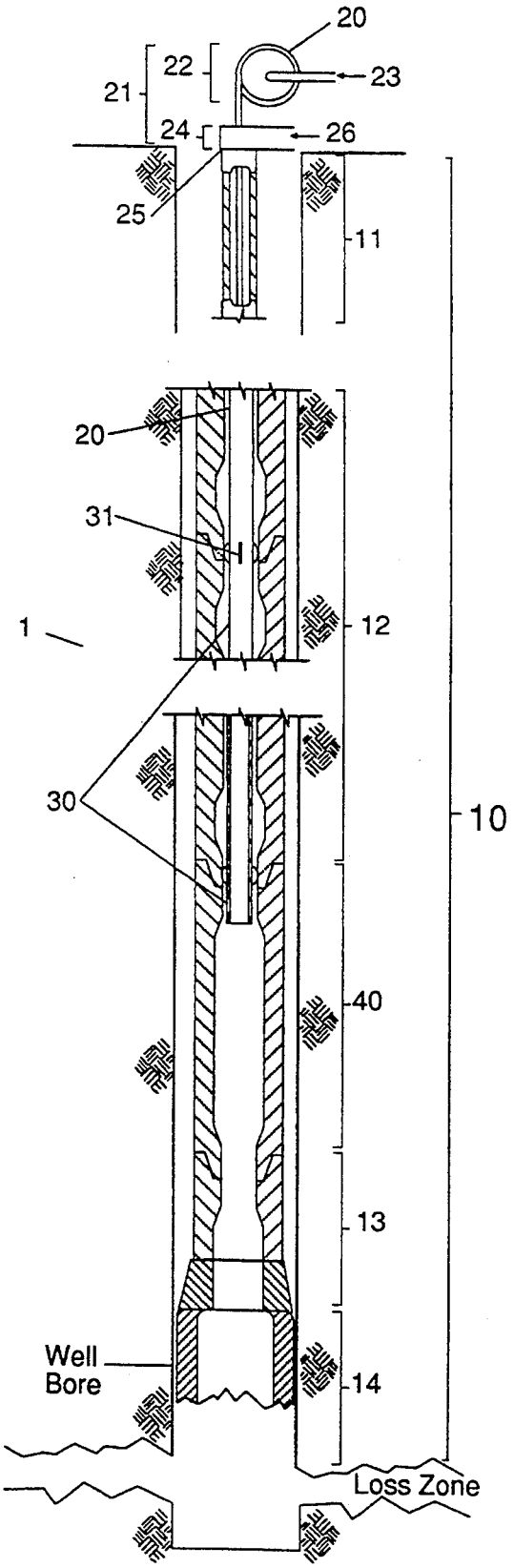
FIG. 1 is a plan view in cross-section of the downhole material injector with the tubing assembly extended through the drill pipe to a location near the drill bit.
Figure 2:
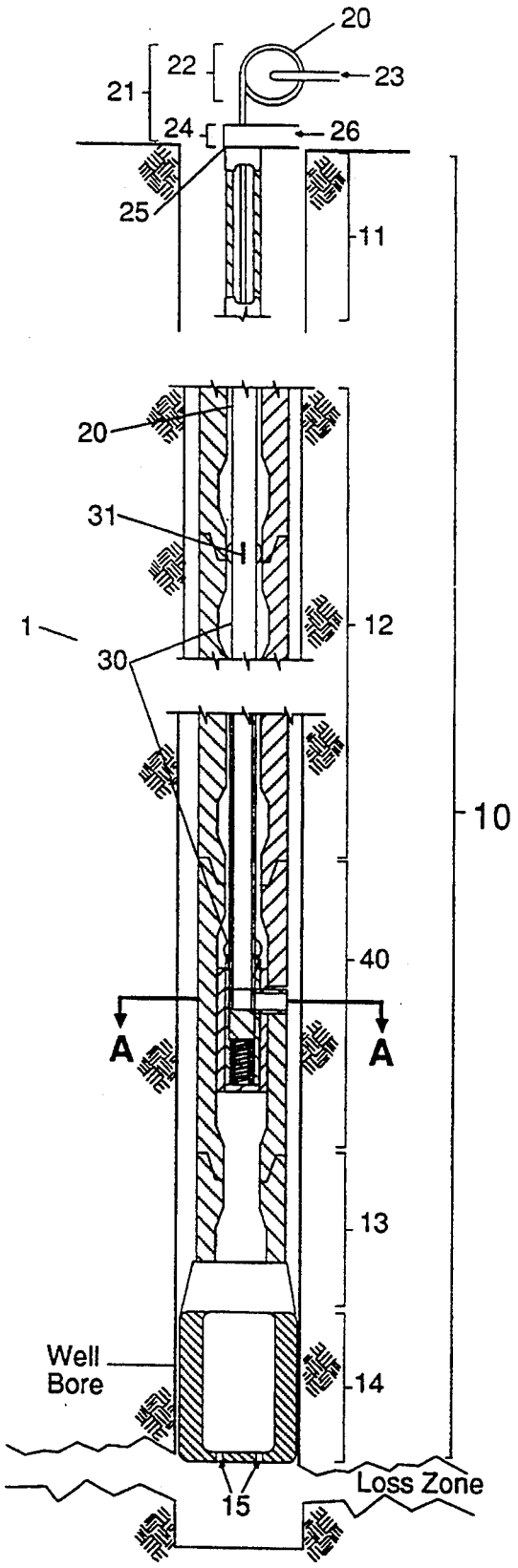
FIG. 2 is a plan view in cross-section of the downhole material injector showing the tubing assembly extended in the drill pipe with the mating section or sealing head approaching the insert or injector assembly.
Figure 4:
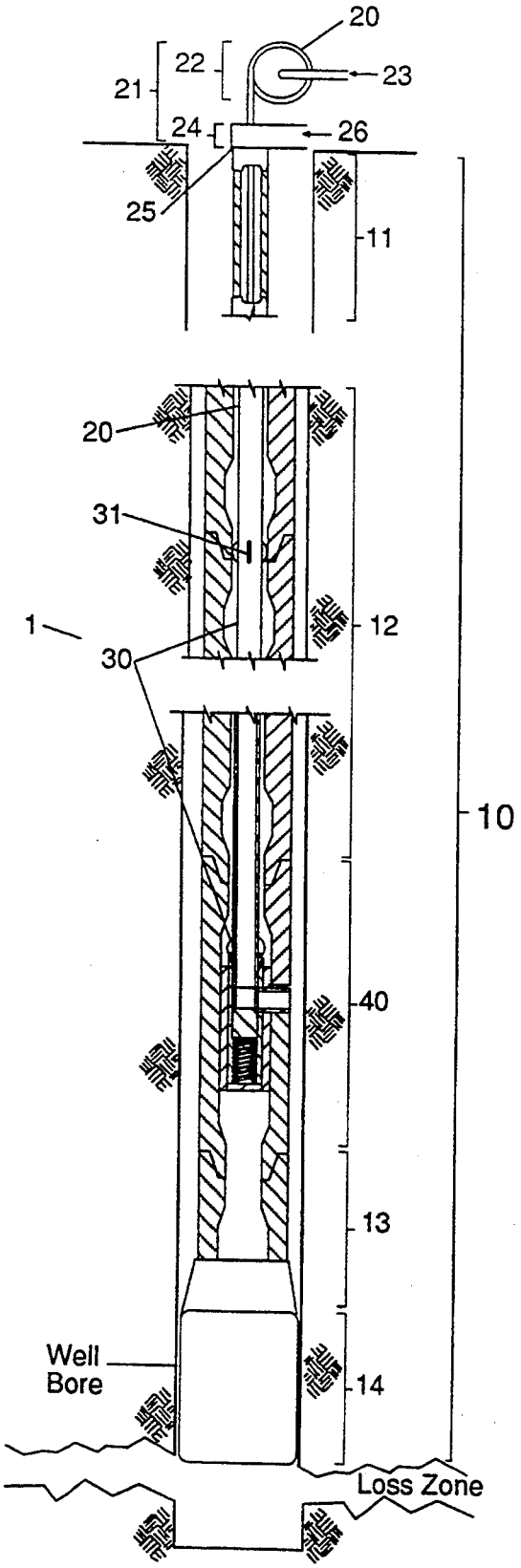
FIG. 4 is a plan view in cross-section of the downhole material injector showing the tubing assembly extended in the drill pipe with the sealing head engaged in the injector assembly.

As shown in the FIGS. 1, 2, and 4, drilling assembly 1 includes drill string 10. Drill string 10 is typical of common drill strings and may be defined here as all the subsurface parts of drilling assembly 1, or all the downhole structural parts that hang into the wellbore from the drill rig (not shown). FIGS. 1, 2 and 4 also show the surface below which the drill string 10 extends and the loss zone of the formation. Drill string 10 includes drill pipe 11 having a hollow center, drill collars 12, crossover sub 13, and drill bit 14 having nozzles 15.

Drill collars are known in the art as the thick-walled central section of the drill pipe, which provide weight to the drill string to push the drill bit into the subsurface formation. The drill collar section of the pipe typically has the same inner diameter as the top portion of the drill pipe, but an increased outer diameter.

Crossover subs are also generally known in the art as the section of the threaded connector that attaches the drill bit to the drill collar section of the drill pipe. The drill bit is the attached tool for cutting into or crushing the rock formation for the purpose of advancing the wellbore. The nozzles are the openings in the bit to the wellbore from which drilling fluid exits the drill string. FIG. 1 is sectioned on the nozzle end of the drill string to show no actual nozzle(s) but rather an open area 15, representing the available fluid exit from the drill string.

There are many known structural configurations of drill bits, which, depending on the type of exploration activity being pursued, may have from one to multiple nozzles. In oil and gas and geothermal drilling, two types of drill bits are widely used, one having cutters and multiple nozzles, the other having rotating cones and three nozzles. At least three nozzles are typical, but for the purposes of this description, FIG. 2 shows only two nozzles 15.

A first embodiment of the invention is shown in FIG. 1 and includes tubing assembly 20, having a hollow center throughout and a surface portion 21 including a coiled upper end 22 with an entrance port 23 for the injection of the accelerator material, typically bridging material, MgO and water, into the drill pipe. Surface portion 21 also includes a head 24 which is threaded at its lower end 25 for connection of the entire tubing assembly 20 to drill string 10, and contains a second entrance port 26 for the provision of the cementitious mud slurry to the drill pipe 11. The entire lower portion of tubing assembly 20, at the opposite end of assembly 20 from the coiled surface portion 21, comprises a stinger tube 30 which is lowered into drill pipe 11 by winding and unwinding of coiled end 22.

Stinger tube 30 is the section of tubing assembly 20 that has a weighted wall to facilitate its travel down the hollow center of drill pipe 11. Stinger tube 30 includes upper centralizing fins 31, sealing head 32 located considerably beneath upper centralizing fins 31 on tubing assembly 20 and having angled upper and lower surfaces 33*a*and 33*b*, respectively, and small centralizing fins 34 attached to its outer circumference. Upper centralizing fins 31 act to space tubing assembly 20 inside drill pipe 11. The sealing head 32 is a short, thicker walled section of tubing assembly 20; its small centralizing fins 34 also act to center and stabilize sealing head 32 inside drill pipe 11.

The basic operation of this first embodiment of the invention is apparent. During normal drilling, fluid and/or drilling mud is pumped down through the drill pipe 11 and out the drill bit nozzle(s) 15 to circulate through the wellbore annulus (the area of the wellbore or hole surrounding the drill string) and back to the surface. When a lost circulation zone is encountered, drill string 10 is pulled up such that bit 14 hangs just above the loss zone. Drill string 10 is disconnected from the draw works (not shown) at the rig floor, and head 24 is moved into connection with, and attached to, the top of drill string 10, as depicted in FIG. 1. Tubing assembly 20 with stinger tube 30 is passed through head 24 and coiled end 22 is advanced to control the lowering of stinger tube 30 into and through drill string 10 to the drill bit 14. Cementitious mud slurry is pumped into port 26 to flow through the hollow center of drill pipe 11, while a slurry of accelerator (and bridging material, if desired) is simultaneously pumped into port 23 to flow through the hollow center of tubing assembly 20. The flows of both materials exit drill pipe 11 and tubing assembly 20, respectively, at nozzle(s) 15 of drill bit 14 to mix together below bit 14 as they flow into the loss zone in the formation below drill string 10, thereby starting the chemical reaction that hardens the cement.

Figure 3:
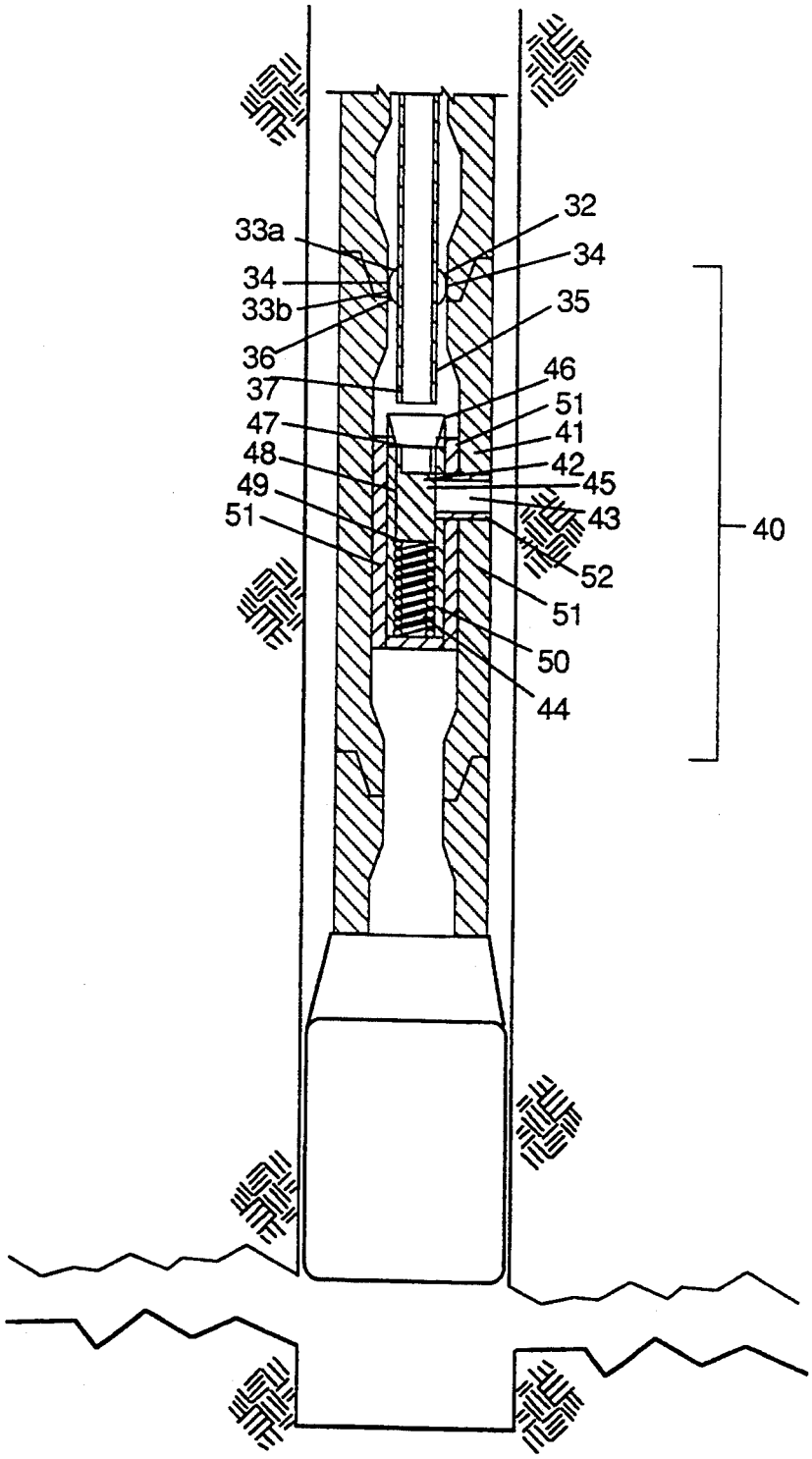
FIG. 3 is a detail view in cross-section of the downhole material injector showing the tubing assembly extended in the drill pipe with the sealing head approaching the injector assembly, which has its valve in closed position.

A second and preferred embodiment of the invention is shown in FIGS. 2, 3, 4, and 5. In this second embodiment, injector assembly 40 is inserted into drill pipe 11 above crossover sub 13. Unlike tubing assembly 20 which is separate and not a permanent part of drill string 10, injector assembly 40 may be formed as a permanent part of drill pipe 11. Referring to FIG. 3, injector assembly 40 generally comprises a short tubular section 41 of drill collar, fastened into drill pipe 11, and fitted with sliding valve 42 and side ejection port 43.

Figure 5:
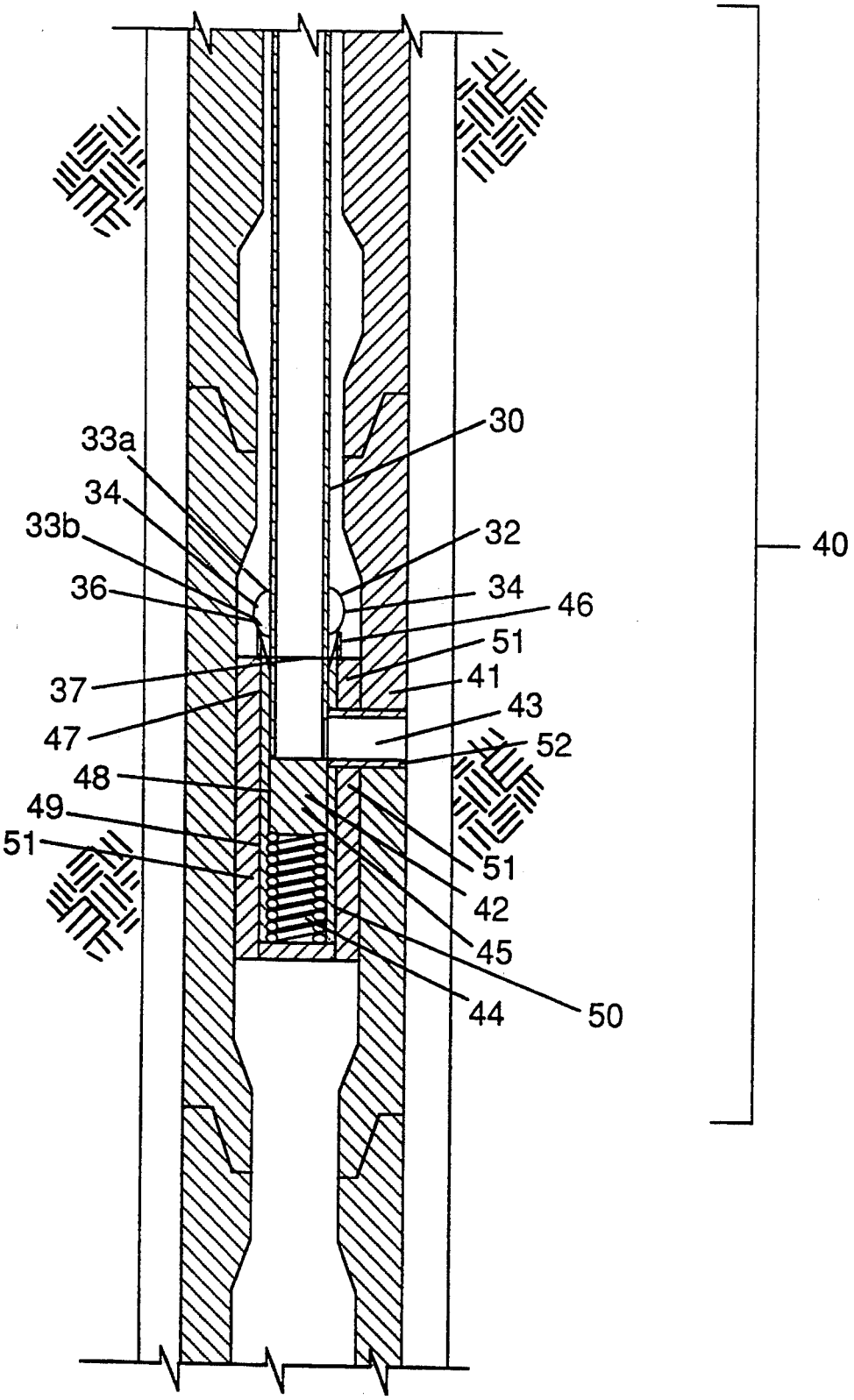
FIG. 5 is a detail view in cross-section of the downhole material injector showing the tubing assembly extended in the drill pipe with the sealing head engaged in the injector assembly, which has its sliding valve in its open position.

As seen in more detail in FIGS. 3 and 5, valve 42 also includes at its lower end spring 44 and piston 45 immediately above spring 44. Spring 44 acts in conjunction with stinger tube 30 to open and close valve 42, as set out in more detail below. Sliding valve 42 also includes beveled lip 46 at the uppermost end, as well as three O-rings 47, 48, 49, spaced along the outer diameter of the piston 45. Piston 45 moves axially inside cylinder 50, which is attached to section 41 with fins 51, or equivalent structure, at two or more locations around cylinder 50. Side ejection port 43 consists of the open passage through a tube 52 that extends radially from a hole in the side of cylinder 50 through a hole in the wall of drill collar 41.

Figure 2A:
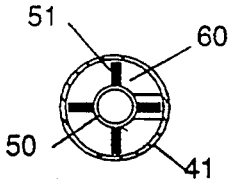
FIG. 2*a* is a cross-sectional view of the injector assembly sectioned at the sliding valve, shown as A—A on FIG. 2.

The operation of the second embodiment of the invention is essentially the same as that of the first embodiment, except that stinger tube 30 acts as a mating part. During normal drilling, injector assembly 40 is passive, allowing drilling fluid to pass through passages 60 (shown in FIG. 2A) between cylinder 50 and section 41, with no significant restrictions and little pressure drop. Spring 44 keeps valve 42 in its raised, closed position, thereby preventing drilling fluid from flowing out side ejection port 43. As with the first embodiment, when a lost circulation zone is encountered, drill string 10 is pulled up to bring bit 14 just above the loss zone. Drill string 10 is disconnected from the draw works, and head 24 is moved into connection with, and attached to, the top of drill string 10, as shown in FIGS. 2 and 4. Tubing assembly 20 with stringer tube 30 is passed through head 24 and lowered toward injector assembly 40 through drill string 10. FIGS. 2 and 3 are schematics showing stinger tube 30 just prior to reaching injector sub 21, and sliding valve 42 in its closed position.

Centralizing fins 34 on sealing head 32 of stringer tube 30 and beveled lip 46 of injector assembly 40 act to ensure that the end of stinger tube 30 passes into sliding valve 42 and contacts the top of piston 45. The weight of stinger tube 30 overcomes sliding valve spring 44, thereby forcing piston 45 down to its open position. The weight of stinger tube 30 also forces angled surfaces **33*b* on sealing head 32 to contact the matching surfaces of beveled lip 46 of sliding valve 42. An O-ring 36 carried in sealing head 32 provides a fluid seal necessary to segregate fluid inside stinger tube 30 from fluid inside drill string 10. An additional O-ring 37 in the terminal end 35 of the stinger tube 30 provides secondary sealing in case O-ring in sealing head 32 fails. FIGS. 4 and 5 are schematics showing stinger tube 30 engaged in injector assembly 40 and sliding valve 42 in its open position. Injector assembly 40 may also include, active clamping devices (not shown) to connect stinger tube 30 to sliding valve 42, but the weight of stinger tube 30 alone should be sufficient to open valve 42** and provide the necessary sealing.

After stinger tube 30 is in place with sliding valve 42 open, a mixture of cementitious mud, typically bentonite, ammonium phosphate (AmPP), borax, and water is pumped downhole through drill string 10 including assembly 40, out bit nozzles 15, and into the wellbore and loss zone. At the same time, a mixture of accelerator materials, typically MgO, bridging materials, and water, is pumped down the tubing assembly 20, through stinger tube 30 and sliding valve 42, out side ejection port 43, and into the wellbore annulus and the loss zone. Again, the two fluid streams mix together below bit 14 as they flow into the loss zone, thereby starting the chemical reaction that hardness the cement.

The outside diameter of injector assembly 40 is typically in the area of 6–9 inches. The inside diameter of drill string 10, including drill pipe 11, is in the area of 3–5 inches. Stinger tube 30 consists of approximately 30 feet in length of small-diameter, heavy-wall pipe, weighing approximately 200–500 pounds. Tubing assembly 20 and stinger tube 30 each have inside diameters of approximately 1 inch, thereby allowing ample flow area for the accelerator fluid as well as relatively large bridging material particles, such as up to $\frac{1}{3}$ inch in diameter. The ability to pass such large particles is extremely desirable in providing temporary plugging of fractures, with the hardened cement acting to make the plugs permanent. The structure of side ejection port 43 is also useful in this regard because particles too large to pass through bit nozzles 15 may be emplaced downhole through port 43. It is considered desirable to space injector assembly 40 as close as possible to drill bit 14, typically within 5 feet, for purposes of enhanced mixing.

The relative sizes of the tubing assembly 20 and the entire drill string 10 are also well matched to the concentrations of MgO accelerator required to provide rapid setting of the cement. Typical flow rates down the drill string range from 100–150 gpm, while those down the coiled tubing range from 5–20 gpm.

To prevent sticking drill bit 14 with bridging materials, the entire drill string 10 may be reciprocated in a vertical plane using the drill rig draw works (not shown).

Although simple, the downhole material injector should provide significant reliability. Other advantages of both the structure and the method of all embodiments of the invention include the ability to operate without tripping drill string 10 out in order to emplace the cement. Tripping and removal of the bit 14 is done with conventional cements because of the fear of pumping such cements through the bit nozzles 15. If premature thickening of the cement occurs, the small restrictions provided by the nozzles 15 could cause the cement to set up in the drill pipe before it can be tripped out. Cementitious muds do not readily set up without the addition of the accelerator; thus the pumping operation according to the invention can be safely done without pulling bit 14. Also, tubing assembly 20 can be run downhole in a relatively short time, thus saving considerable time over that required for conventional cement treatments.

In wireline coring or other exploration applications of the invention, the embodiment of FIG. 1 with injector assembly 40 deleted is most appropriate. As previously explained, FIG. 1 is sectioned on the nozzle end of the drill string to show no actual nozzle(s) but rather an open area 15, representing the available fluid exit from the drill string. In this application, the core barrel used for wireline coring systems (i.e. the barrel for holding the rock core) is temporarily removed, and tubing assembly 20 is run down to the bit 14. Accelerator fluid and bridging material are discharged through the coiled tubing and out bit 14 directly into the fluid stream flowing down drill pipe 11.

The particular sizes and equipment disclosed above are cited merely to illustrate particular embodiments of the invention. It is contemplated that use of this invention may involve components having different sizes and other parameters as long as the principle described herein is followed. A downhole material injector assembly, constructed in accordance with the present invention, will provide the capability of pumping two fluid streams separately, but simultaneously, downhole in order to emplace a two-component plugging material, such as cementitious mud, downhole for lost circulation control without mixing the components prior to their emplacement in the wellbore. It is intended that the scope of the invention be defined by the claims appended hereto.

What is claimed is:

1. A downhole grout injector system for circulation control in a borehole extending downhole from a surface whereby two streams of grout component materials are simultaneously and separately emplaced through said borehole to a downhole location, said system comprising:

pipe means extending from said surface to a downhole location for delivering one of said two streams;

tubing means retractively positioned within said pipe means for delivery of the other of the two streams, the downhole end of said tubing means including in a section of heavy wall tubing of sufficient weight to facilitate its movement downward within said pipe means and including centering means attached thereto for approximately centering said section of heavy wall tubing within said pipe means without significantly blocking the flow of said one stream;

an injection assembly centrally positioned within and fastened to said pipe means near the lower end thereof, said injector assembly comprising;

a short length of tubular housing fastened to the interior surface of said pipe means by fastening means that do not significantly block the flow of the other of said fluids;

an input port within said pipe means aligned with the downhole end of said tubing means;

an ejection port extending through said pipe means; and valve means to control communication of fluid from said input port to said ejection port, said valve means comprising a piston having a cut-out portion at the input end, said piston sliding within said tubular housing from a first position where its body at the opposite end blocks fluid flow through said ejection port to a second position where said cut-out portion allows fluid flow from the input end through said ejection port; and spring means for resiliently supporting said piston in said first position, said tubing means selectively engaging said piston at its input end to cause it to move against said spring means to said second position.

2. A downhole material injector system for lost circulation control in a borehole extending downhole from a surface, said system comprising an emplacing means for simultaneously and separately emplacing two streams of materials through said borehole to a downhole location, said emplacing means comprising:

a) a pipe means for delivering one of said streams into a downhole area; and b) a retractable tubing means within said pipe means for delivery of the other of said streams to said downhole area, said tubing means being weighted for facilitating movement of said retractable tubing means downward within said pipe means;

c) centering means for approximately centering said tubing means within said pipe means without significantly blocking the flow of said one stream;

d) an injector assembly fastened to said pipe means, said injector assembly comprising an input port within said pipe means aligned with the downhole end of said tubing means, said injector assembly further comprising a short length of tubular housing fastened to the interior surface of said pipe means by fastening means that does not significantly block the flow of fluid past said assembly within said pipe means;

e) an ejection port extending through said pipe means;

f) a valve means movable from a closed position to an open position to control communication of fluid from said input port to said ejection port, said valve means further comprising a piston having a cut-out portion at the input end, said piston sliding within said housing from a first position where its body at the opposite end blocks flow through said ejection port to a second position where said cut-out portion allows fluid flow from the input end through said ejection port, and a spring means for resiliently holding said piston in the first position, whereby the output end of said retractable tubular means moves said piston to the second position, said valve means being closed when said input port is not connected to said tube means and said valve means being open when said input port is connected to said retractable tubular means;

wherein said other of said streams flows through said tubing means and through said valve means, after engagement of said valve means by said tubing means, to the outside of said pipe means through said output port of said injector assembly, said one of said streams flowing around said injector assembly through said piping means to a downhole location, and said streams mixing together outside of said system at the downhole location requiring lost circulation control and hardening to control lost circulation only after said mixing.

3. A downhole material injector system for lost circulation control in a borehole extending downhole from a surface, said system comprising an emplacing means for simultaneously and separately emplacing two streams of materials through said borehole to a downhole location, said emplacing means allowing said streams of material to combine outside of said downhole material injector system and said emplacing means at said downhole location, said emplacing means further comprising:

a) a pipe means for separately delivering one of said streams to a downhole location outside of said injector system;

b) a retractable tubing means, within said pipe means, for separate delivery of the other of said streams to said downhole location outside of said system, said tubing means being weighted for facilitating movement of said retractable tubing means within said pipe means; and c) an injector assembly fastened to the interior surface of said pipe means by fastening means that do not significantly block the flow of fluid past said injector assembly within said pipe means, said injector assembly further comprising:

i) an input port within said pipe means and aligned with the downhole end of said tubing means;

ii) an ejection port extending through said pipe means; and iii) a valve means movable from a closed position to an open position to control communication of fluid from said input port to said ejection port wherein said valve means is closed when said input port is not connected to said tubing means and said valve means being open when said input port is connected to said tubing means, whereby said other stream flows to the outside of said pipe means through said injector assembly.

4. A downhole material injector system for lost circulation control in a borehole extending downhole from a surface, said system comprising an emplacing means for simultaneously and separately emplacing two streams of materials through said borehole to a downhole location, said emplacing means allowing said streams of materials to combine outside of said downhole material injector system and said emplacing means at said downhole location, said emplacing means further comprising:

a) a pipe means for separately delivering one of said streams to a downhole location outside of said injector system;

b) a retractable tubing means, within said pipe means, for separate delivery of the other of said streams to said downhole location outside of said system, said tubing means being weighted for facilitating movement of said retractable tubing means within said pipe means; and c) an injector assembly fastened to said pipe means, said injector assembly comprising an input port within said pipe means and aligned with the downhole end of said tubing means, an ejection port extending through said pipe means, and a valve means movable from a closed position to an open position to control communication of fluid from said input port to said ejection port wherein said valve means is closed when said input port is not connected to said tubing means and said valve means being open when said input port is connected to said tubing means, wherein said other stream flows to the outside of said pipe means through said injector assembly, said valve means further comprising:

i) a piston having a cut-out portion at the input end, said piston sliding within said housing from a first position where its body at the opposite end blocks fluid flow through said ejection port to a second position where said cut-out portion allows fluid flow from the input end through said ejection port: and ii) a spring means for resiliently holding said piston in the first position, wherein the output end of said tubing means moves said piston to the second position.

* * * * *